United States Patent [19]

Stein et al.

[11] Patent Number: 4,571,585

[45] Date of Patent: Feb. 18, 1986

[54] MATRIX ADDRESSING OF CHOLESTERIC LIQUID CRYSTAL DISPLAY

[75] Inventors: Charles R. Stein, Schenectady; John E. Bigelow, Clifton Park, both of N.Y.

[73] Assignee: General Electric Company, Schenectady, N.Y.

[21] Appl. No.: 476,076

[22] Filed: Mar. 17, 1983

[51] Int. Cl.[4] ..... G09G 3/36

[52] U.S. Cl. ..... 340/784; 340/805; 350/346

[58] Field of Search ..... 340/784, 805, 791, 789; 350/346

[56] References Cited

U.S. PATENT DOCUMENTS

| | | | |
|---|---|---|---|
| 3,816,824 | 6/1974 | Thust et al. | 340/789 |
| 3,936,815 | 2/1976 | Kogure et al. | 350/346 |
| 4,317,115 | 2/1982 | Kawakami et al. | 340/805 |
| 4,405,209 | 9/1983 | Funada et al. | 350/346 |
| 4,408,201 | 10/1983 | Harada | 340/805 |

*Primary Examiner*—Marshall M. Curtis

*Attorney, Agent, or Firm*—Geoffrey H. Krauss; James C. Davis, Jr.; Marvin Snyder

[57] ABSTRACT

Methods for matrix addressing a liquid crystal display, utilizing the cholesteric-to-nematic phase change for information display, provides a voltage to each of a plurality of scanned electrodes. A preferred voltage waveform has a first non-zero value during an erase interval and a greater non-zero value during a display-write interval. The combined erase and write intervals occur, for each scanned electrode, once during a multiplex time interval. Each of another plurality of electrodes, arranged adjacent to the remaining surface of a liquid crystal layer and perpendicular to the scanned electrodes, are sequentially energized with a non-zero voltage having a polarity change coincident with the erase and write intervals when that portion of a display at the intersection of the first and second plurality of electrodes is to be addressed. If the inverted-polarity voltage is in phase with the scan electrode voltage, the liquid crystal material is switched to the cholesteric state and absorbs incident light, whereas if the inverted-polarity voltage is out-of-phase with the scan electrode erase-write pulse, the intersection is switched to the nematic state and incident light is transmitted through the cell substantially without attenuation.

33 Claims, 27 Drawing Figures

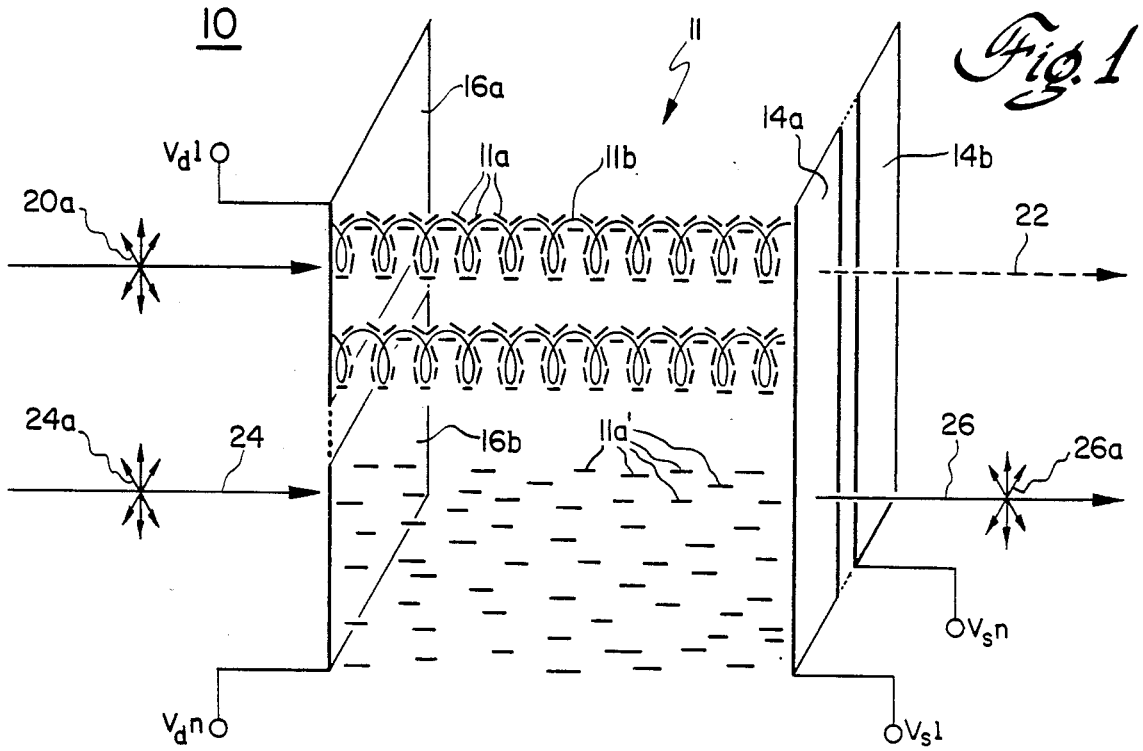
Fig. 1
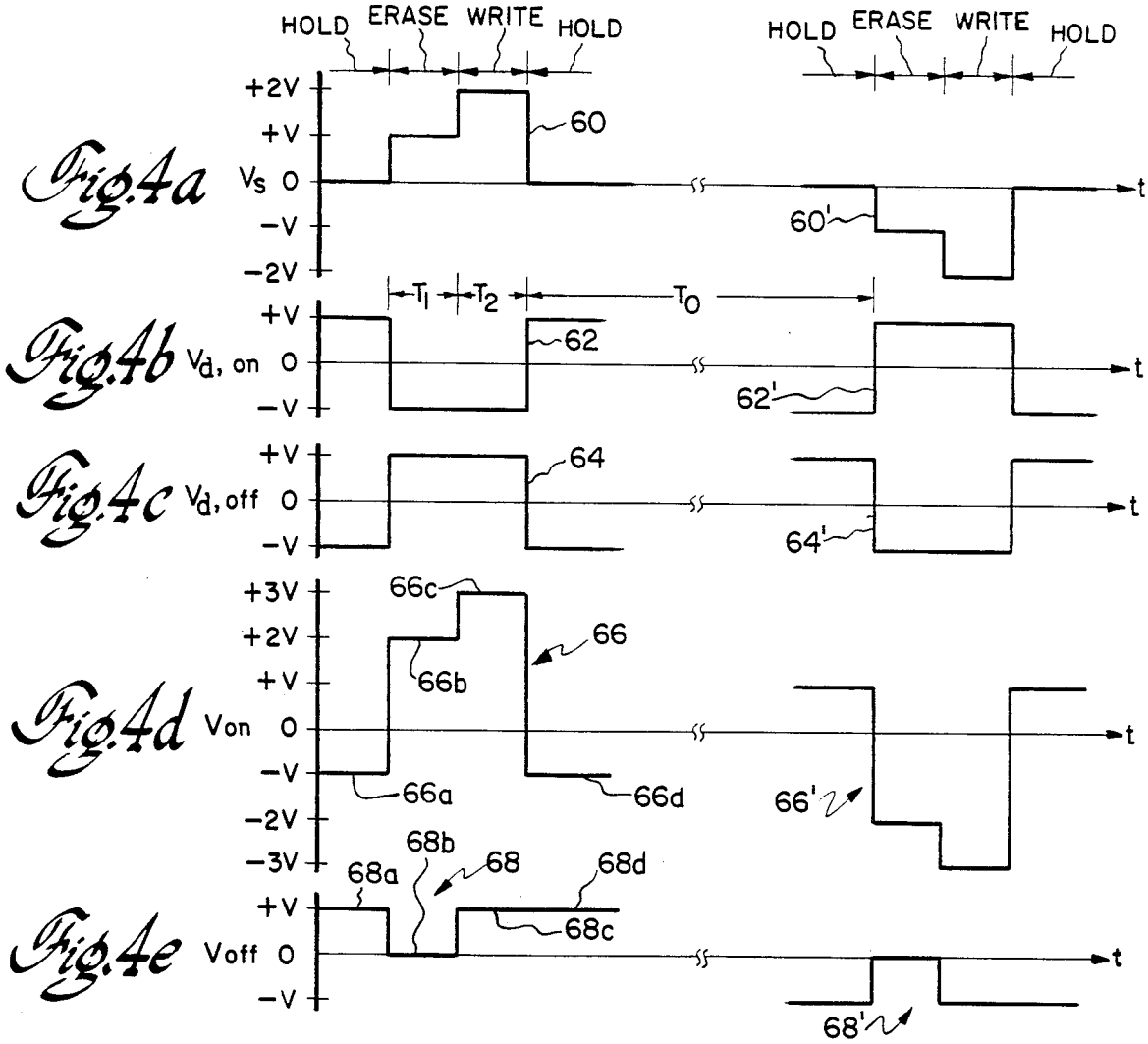
Fig. 4a
Fig. 4b
Fig. 4c
Fig. 4d
Fig. 4e

Vd,c
+VON/3
0
−VON/3
30
t

Vd,n
+VON/3
0
−VON/3
32
t

Vs,on
+2VON/3
+VON/3
0
−VON/3
−2VON/3
34
t

Vs,off
+VON/3
0
−VON/3
36
t

|Vs,off−Vd,n|
2VON/3
VON/3
0
38a
38b
38a
38
t

|Vs,off−Vd,c|
VON/3
0
42b
42a
42b
42
t

|Vs,on−Vd,n|
VON/3
0
40
t

|Vs,on−Vd,c|
VON
2VON/3
VON/3
0
T
44b
44a
44b
44
t $V'_{d,c}$
$+V_{ON}/2$
$+V_{ON}/3$
$+V_{ON}/6$
0
$-V_{ON}/6$
$-V_{ON}/3$
$-V_{ON}/2$
30'
t $V'_{d,n}$
$+V_{ON}/6$
0
$-V_{ON}/6$
32'
t $V'_{s,on}$
$+V_{ON}/2$
$+V_{ON}/3$
$+V_{ON}/6$
0
$-V_{ON}/6$
$-V_{ON}/3$
$-V_{ON}/2$
46a
46d
46
46c
46b
t $V'_{s,off}$
$+V_{ON}/2$
$+V_{ON}/3$
$+V_{ON}/6$
0
$-V_{ON}/6$
$-V_{ON}/3$
$-V_{ON}/2$
48c
48a
48
48b
48d
t $|V'_{s,off}-V'_{d,n}|$
$2V_{ON}/3$
$V_{ON}/3$
0
50a
50b
50
50a
t $|V'_{s,on}-V'_{d,n}|$
$V_{ON}/3$
0
52
t $|V'_{s,off}-V'_{d,c}|$
$V_{ON}/3$
0
54a
54b
54
54c
t $|V'_{s,on}-V'_{d,c}|$
$V_{ON}$
$2V_{ON}/3$
$V_{ON}/3$
0
56a
56b
56
T'
56c
t

MATRIX ADDRESSING OF CHOLESTERIC LIQUID CRYSTAL DISPLAY

BACKGROUND OF THE INVENTION

The present invention relates to multiplexing of information displays and, more particularly, to novel methods for matrix addressing cholesteric-to-nematic phase change liquid crystal displays.

It is known that matrix addressing may be utilized with liquid crystal displays utilizing a liquid crystal material employing the cholesteric-to-nematic phase change. Hitherto known matrix addressing methods have typically maximized the RMS change of the voltage in each display cell formed at an intersection between the perpendicularly-arranged row and column electrodes placed upon opposite sides of the display liquid crystal layer. By merely maximizing the RMS voltage change, relatively poor performance is achieved, as the response time is typically too long to allow a high order of multiplexing, while unsatisfactorily small contrast ratios are achieved.

It has been suggested to matrix address a cholesteric liquid crystal matrix by sequentially addressing the electrode intersections thereof with waveforms which have, for a period of time, a zero value of voltage at each intersection. The zero intersection voltage is utilized to erase the intersection display state, in a time slot immediately prior to a time slot in which the desired display state is "written" into the display intersection. Thus, when a scan pulse sequentially traverses a plurality of scan electrodes, the liquid crystal material is first caused to go into the focal-conic state and is then realigned into the homeotropic nematic state where desired. This erasing of an intersection previously in the homeotropic nematic state, and subsequent realignment into the same homeotropic nematic state, causes a noticeable blink in the display, which blink occurs at the multiplex rate. During the time interval between each "write" time interval and the next "erase" time interval, the particular display intersection is maintained in a desired state by placing a holding voltage (typically having a value greater than the value required to turn the intersection cell "off" and less than a value required to turn that intersection's cell to the "on" condition. The intersection data waveform is typically utilized as the holding voltage waveform, whereby the amplitude of the data waveform must be a compromise between havng the desired homeotropic state of an intersection cell decay before the cell can be refreshed (if the holding voltage is of too small a value) and having the intersection cell partially activated out of the focal-conic state (if too large a holding voltage is used).

It is therefore highly desirable to provide a method of matrix addressing a multiplexed cholesteric liquid crystal display, wherein the matrix addressing method only erases those intersection cells which have been, or which are going to be, placed in the light-scattering state (or the light-absorbing state if a dichroic dye guest is present). Those intersection cells of the matrix display which have been, or are going to be, in the light-transmitting homeotropic state are to have the homeotropy thereof enforced; blinking is thereby eliminated and no compromise of holding voltage magnitude need be made.

BRIEF SUMMARY OF THE INVENTION

In accordance with the invention, methods are provided for matrix addressing a multiplexable liquid crystal display utilizing the cholesteric-to-nematic phase change and having a first plurality of scan electrodes arranged parallel to one another adjacent to a first surface of a liquid crystal layer and a second plurality of data electrodes arranged parallel to one another, and perpendicular to the elongated direction of the scan electrodes, adjacent to the remaining surface of the liquid crystal layer. Each scan electrode is held substantially at a zero voltage magnitude, except when the intersection cells defined by that scanned electrode are to be addressed; an addressed cell receives a scan voltage having an erase interval preceding a write interval. Advantageously, the scan voltage has a value, during the write interval, of twice the magnitude of the voltage present during the erase interval. Each of the data electrodes receives a non-zero magnitude waveform having a first polarity and magnitude at all times, except for the erase/write time interval when an intersection cell, partially defined by that data electrode, is to be addressed. During the addressed time interval, the data electrode waveform has an inverted-polarity voltage, of the same magnitude as during the holding time interval, thereon. The data waveform is caused to be of the same polarity as the scan waveform if the intersection cell is to be turned "off" into the cholesteric light-absorbing state, but is of the opposite polarity to the scan voltage write/erase pulses if the intersection cell is to be turned "on" into the nematic light-transmitting state.

In one presently preferred embodiment of the invention, the data voltage magnitude is substantially equal to the erase voltage magnitude of the scan voltage, and substantially equal to one-half the write voltage magnitude. The polarity of the data and scan voltages are periodically reversed, such as at the beginning of each matrix multiplexing cycle, to provide an alternating-polarity waveform serving to provide the zero-magnitude DC voltage required to prevent deleterious changes in the liquid crystal layer, with respect to time.

In other presently preferred embodiments of the invention, scanning voltage waveforms having opposite-polarity-half cycles are utilized, with or without a square wave bias waveform voltage, to multiplex the display cell at the intersection of scan and data electrodes thus energized.

Apparatus for automatically enabling the appropriate voltages to the appropriate electrode lines, utilizing a microcomputer and the like, is also provided, for carrying out the methods of the present invention.

Accordingly, it is one object of the present invention to provide novel methods for matrix addressing a multiplexable display utilizing a cholesteric liquid crystal material.

It is another object of the present invention to provide novel control apparatus for facilitating matrix addressing by any appropriate method therefor.

These and other objects of the present invention will become apparent upon consideration of the following detailed description, when read in conjunction with the drawings.

BRIEF DESCRIPTION OF THE DRAWINGS

FIG. 1 is a perspective view of a portion of a multiplexable cholesteric liquid crystal display, and useful in understanding the principles of the present invention;

FIGS. 4*a*–4*e* are a set of interrelated graphs illustrating, respectively, the scan, on-data, off-data, cell-on and cell-off voltage waveforms, in accordance with another method using the principles of the present invention;

DETAILED DESCRIPTION OF THE INVENTION

Figure 1A:
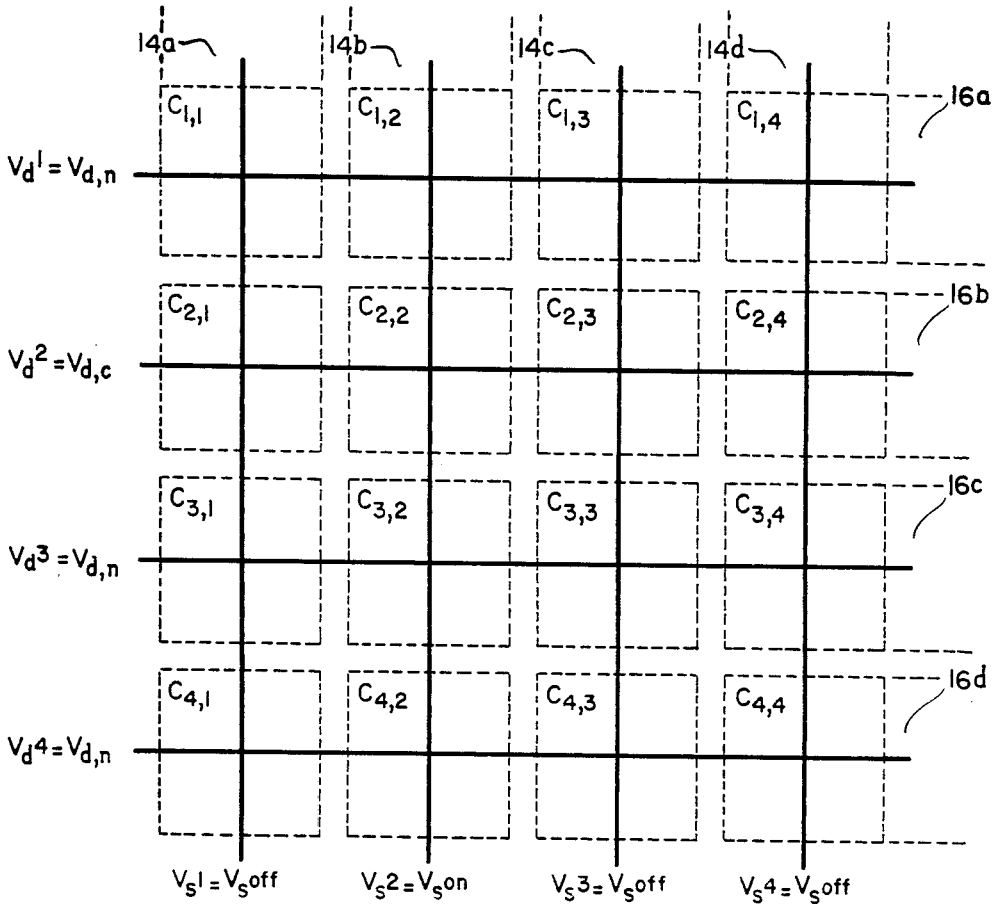
FIG. 1*a* is a somewhat schematic representation of one possible cell matrix forming a portion of a display, and useful in understanding the principles of the present invention.
Figure 1B:
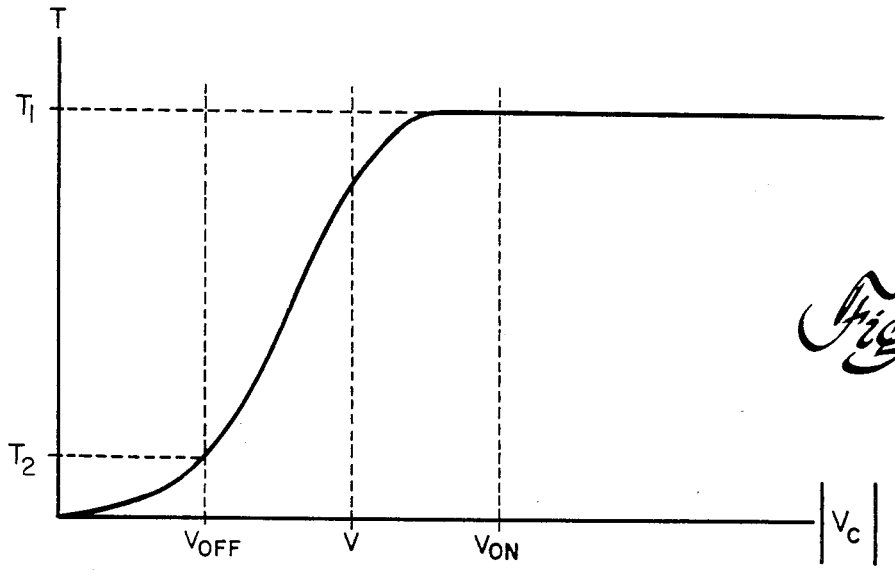
FIG. 1*b* is a graph illustrating the light transmissivity T of a typical display cell, with respect to the absolute magnitude of the total cell voltage $V_c$ across that cell.

Referring initially to FIGS. 1, 1*a* and 1*b*, a multiplexable matrix-addressed liquid crystal display 10 includes a layer 11 of a cholesteric liquid crystal composition. The composition, as illustrated, includes guest dichroic dye molecules 11*a*, having their elongated axes aligned responsive to the alignment of host cholesteric-nematic liquid crystal molecules 11*b*. It should be understood that the present invention generally applies to all cholesteric systems which transmit or scatter light if no dye is present and which, as in the illustrated example, will transmit or absorb light with dye molecules as guests in the host material.

A first plurality of elongated, transparent, conductive scan electrodes 14 are arranged in a first plane substantially adjacent to a first surface of the liquid crystal layer; illustratively, the first plurality of scan electrodes 14 are arranged in the vertical direction. Another plurality of electrodes 16 are arranged parallel to one another in another plane substantially adjacent to the remaining surface of layer 11, and elongated in a direction substantially perpendicular to the elongated direction of scanned electrodes 14 flow. Row electrodes 16 are referred to as data electrodes.

A multiplicity of cells (FIG. 1*a*) are formed in display 10, at the intersections of the vertically-arranged scan column electrodes 14 (i.e. the four illustrated scan electrodes 14*a*–14*d*) and the horizontally-arranged data electrodes 16 (e.g. the four illustrated data electrodes 16*a*–16*d*). Each of the cells, e.g. $C_{1,1}$ through $C_{4,4}$ formed at an intersection of a scan electrode 14 and a data electrode 16, is individually operated to one of light-transmitted and light-absorbed conditions by the difference in voltage present at the particular combination of the data and scan electrodes defining that particular cell at the crossing point thereof. Thus, as shown most clearly in FIG. 1, for a relatively low magnitude of voltage $V_d$1 on a data electrode, e.g. data electrode 16*a*, and a scan voltage $V_s$1 on a column electrode 14*a*, the liquid crystal material (in a cell $C_{1,1}$) therebetween has the host molecules thereof in the cholesteric state, wherein the host liquid crystal molecules have a helical twist imparted thereto. The guest dichroic dye molecules 11*a* sympathetically align with helical disposition. A ray 20 of randomly polarized light will enter cell 10, through electrode 16*a* and, as the electric polarization vectors 20*a* thereof encounter dichroic dye molecules with random orientation, the light ray is substantially absorbed in this "off" intersection cell, whereby the exiting light ray 22 is of substantialy zero magnitude. If the total voltage across an intersection cell is sufficiently large, as is the voltage in the lower intersection cell defined by voltage $V_d$n on electrode 16*a* and the scan voltage on scan electrode 14*a*, the helically-twisted host liquid crystal molecules are "stretched" and aligned with their long axes substantially perpendicular to the electrode surfaces, in the homeotropic state. The guest dye molecules 11*a*′ sympathetically align in the homeotropic state, whereby an entering light ray 24, having random polarization vectors 24*a*, encounters the liquid crystal moledules in end-on configuration and pass substantially unattenuated through the cell, to emerge as a light ray 26 having randomly polarized light vectors 26*a*.

It is known that hysteresis exists in a liquid crystal material, whereby a pulse of voltage impressed between the column and row electrodes 14 and 16 will not only switch the liquid crystal material in that intersection cell to the "on" condition, if the voltage magnitude is sufficiently large, but will also be stored for some time interval, whereby other intersection cells may be turned on or off before the first intersection cell must have voltage reapplied thereto to "refresh" the cell state. The required voltage levels, and refresh cycle times, setting the multiplex order of a particular display, are functions of cell construction and liquid crystal material constants and are selectable in accordance with data well known to the art. It is also known, as shown in FIG. 1*b*, that having been turned on (to a high transmissivity value $T_1$ by a cell voltage $V_c$ greater than or equal to the cell "on" voltage $V_{ON}$) or off (to a low transmissivity value $T_2$ by a cell voltage $V_c$ less than or equal to the cell "off" voltage $V_{OFF}$) a particular intersection cell will remain in the selected state, even if the voltage across that cell is somewhat changed; the magnitude of this "holding" voltage $V_H$ is a function of display materials and design, and hitherto was the result of a compromise, as previously described hereinabove. Advantageously, the cell voltage provided for turning the cell on to the high transmissivity condition will be as large as possible, as the transition time from the "off" to "on" condition is proportional to the cell voltage, whereby a significant decrease in turn-on time will be provided for large cell voltage in the "on" condition. It is well known that the time required for relaxation of the cell material from the "on" condition to the "off" condition is material, rather than voltage, dependent; however, data and scan electrode waveforms can, under certain conditions, reduce the turn-off time.

Referring now to FIGS. 1*a* and 2*a*–2*h*, a first presently preferred method for matrix scanning the display of FIG. 1*a* utilizes a pair of oppositely-phased data electrode waveforms 30 and 32 (FIGS. 2*a* and 2*b*), each having a magnitude of $\pm V_{on}/3$. The first waveform 30 is provided as the signal voltage $V_{d,c}$ to the data row electrode, e.g. 16*b* of the row in which a cell, e.g. cell $C_{2,2}$, is to have the transmissivity state thereof changed. The remaining rows receive the no-change data electrode waveform voltage $V_{d,n}$ waveform 32 of FIG. 2*b*. The cell state is determined by that one of a pair of scan waveforms 34 or 36 (FIGS. 2*c* or 2*d*) provided to the scan electrode 14. In general, the scan electrodes of columns not being presently operated upon are provided with the $V_{s,off}$ waveform 36, which has a single cycle of a squarewave at the same frequency as the data electrode waveform signal, a polarity which is the same as the polarity of the change waveform $V_{d,c}$ voltage and the same magnitude (e.g. $\pm V_{on}/3$). Only the one scan electrode, e.g. electrode 14*b* for cell $C_{2,2}$, can receive either the "on" waveform 34 or the "off" waveform 36, dependent upon the state of the cell $C_{2,2}$ to be provided. Illustratively, cell $C_{2,2}$ is to be turned on and the scan electrode voltage $V_s$2 is set to $V_{s,on}$ waveform 34. The "on" scan waveform 34 voltage is also a single cycle of the square wave having the same frequency and polarity as the no-change waveform $V_{d,n}$ voltage but with twice the magnitude (e.g. $\pm 2V_{on}/3$) thereof.

Figures 2A, 2B, 2C, 2D, 2E, 2F, 2G, 2H:
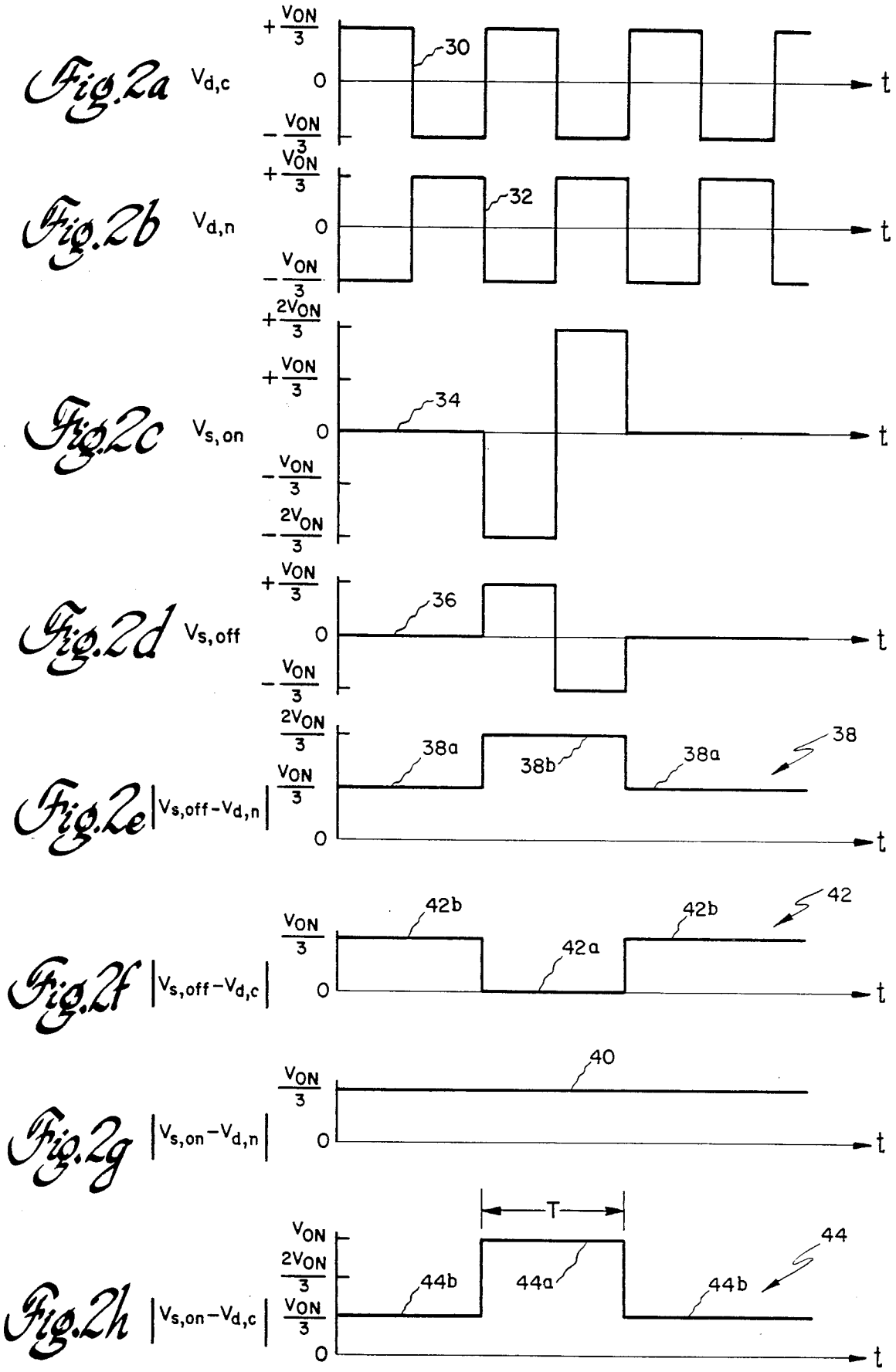
FIGS. 2*a*–2*h* are a set of interrelated graphs illustrating the various electrode and total cell waveform voltages utilized in accordance with the principles of one embodiment of the present invention.

Under these conditions, each of the cells (cells $C_{1,1}$, $C_{1,3}$, $C_{1,4}$, $C_{3,1}$, $C_{3,3}$, $C_{3,4}$, $C_{4,3}$ and $C_{4,4}$), in the non-selected rows and columns receives both the waveform 32 and waveform 36; and these cells have a total cell absolute-value waveform voltage as shown in FIG. 2*e*. For data electrode waveforms 30 and 32 of square waveshape and amplitude $\pm V_{on}/3$ and for a similar amplitude for the "off" scan waveform 36, these unaffected cells receive a $V_{on}/3$ amplitude voltage portion 38*a* before and after the changing-interval T, when the scan electrode is enabled to a non-zero level. During the scanned interval T, the "held" cells have a 2 $V_{on}/3$ amplitude portion 38*b*. It will be seen that the cell voltage never increases to the $V_{on}$ level and these cells, receiving the FIG. 2*e* waveform, have a cell voltage falling on the substantially-linear portion of the transmissivity curve, which does not allow the cell to change state, but which merely holds the cell in a previously-actuated state.

Cells defined by a no-change data row electrode, such as row electrodes 16*a*, 16*c* and 16*d* in the illustrated example, and the scan electrode defining a selected cell (scan electrode 14*b* in the illustrated case) have a voltage thereacross defined by the difference between the scan electrode "on" voltage $V_{s,on}$ and the no-change data electrode voltage $V_{d,n}$. These cells, e.g. cells $C_{1,2}$, $C_{3,2}$ and $C_{4,2}$, have an absolute voltage thereacross having the waveform 40 of FIG. 2*g*, i.e. a substantially constant voltage of absolute magnitude $V_{on}/3$, serving to hold these cells in the condition previously established therein.

The cell being presently operated on, e.g. cell $C_{2,2}$, will, if the scan electrode voltage is the "off" voltage waveform 36, have a total voltage waveform 42 (of FIG. 2*f*), impressed thereacross. Thus, the cell voltage falls to substantially zero magnitude in that waveform portion 42*a* during the scan interval T and is of a magnitude $V_{on}/3$ in waveform portions 42*b* before and after the scan interval T. The average voltage is thus of magnitude less than $V_{on}/3$; the cell is turned off during interval T and is, if $V_{off}$ is less than $V_{on}/3$, subsequently held off. If, as illustrated in FIG. 1*a*, the cell-on scan waveform 34 is provided, the waveform 44 of FIG. 2*h* appears across the cell. Before and after the scan interval T, waveform portions 44*b* have the same absolute magnitude ($V_{on}/3$) as the off-cell waveform 42 magnitude at the same time. During the scan interval T, the on-cell waveform portion 44*a* has a magnitude $V_{on}$, which is three times as great as the holding voltage and is sufficient to turn the cell to the "on", condition. Thus, in interval T, the cell is rapidly turned on and, as the average value of waveform 44 is greater than $V_{OFF}$, that cell remains "held" in the "on" condition after interval T ends.

Figures 3A, 3B, 3C, 3D, 3E, 3F, 3G, 3H:
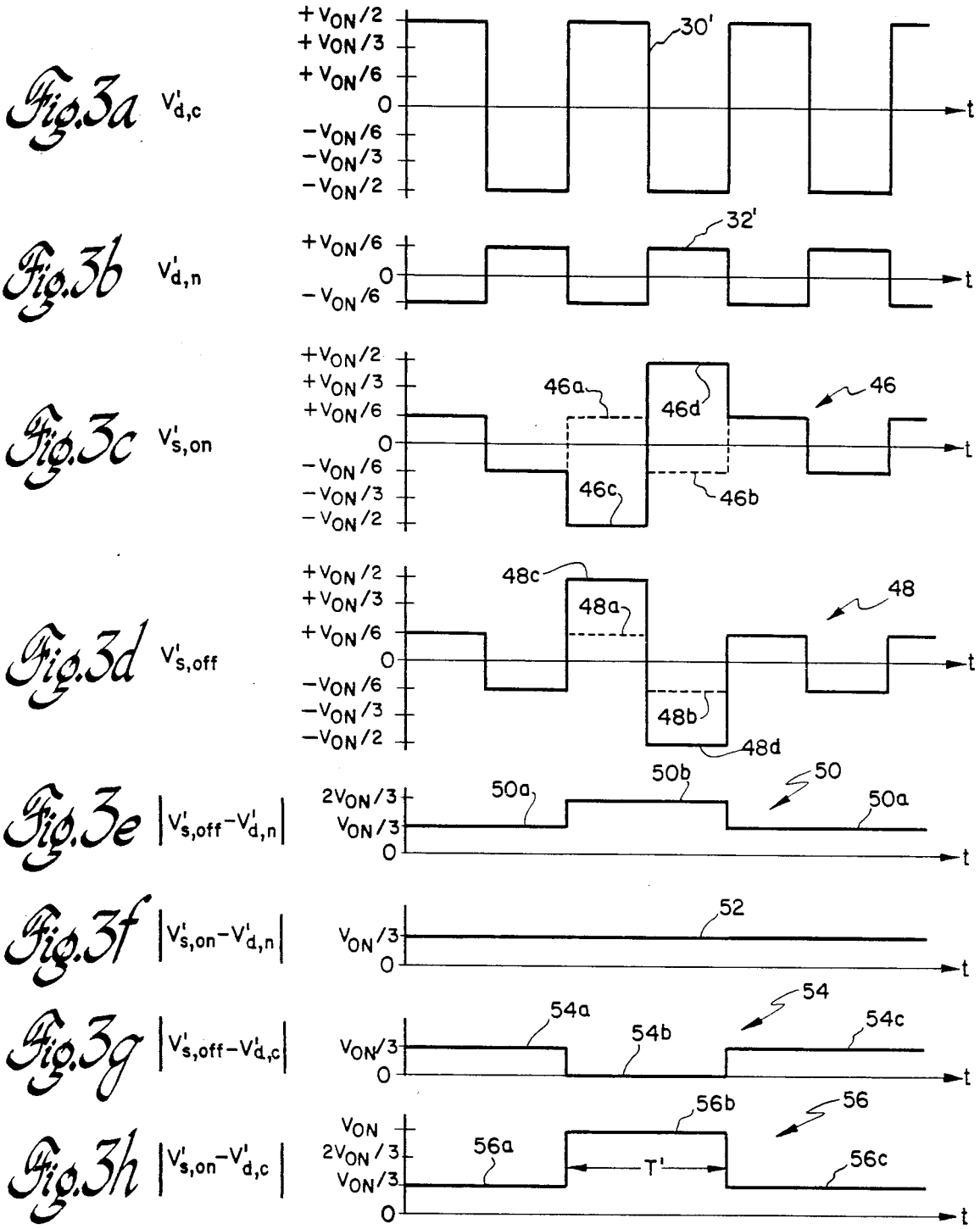
FIGS. 3*a*–3*h* are a set of interrelated graphs illustrating the various electrode and total cell waveform voltages for another preferred embodiment of the present invention.

Referring now to FIGS. 3*a*–3*h*, it is often desirable to reduce the time during which a steady-state DC voltage is present on any display electrode (such as utilized for the $V_{s,on}$ and $V_{s,off}$ waveforms of FIGS. 2*c* and 2*d*). In addition, by balancing the peak voltage on each set of electrodes, the peak voltage swing, required for controlling a particular cell, can be reduced. Therefore, a bias square waveform is added to the "on" and "off" scan waveforms (FIGS. 3*c* and 3*d*). The bias waveform voltage is of the same frequency as the data electrode waveform voltages (FIGS. 3*a* and 3*b*). The no-change data waveform $V'_{d,n}$ voltage is now provided at an amplitude ($\pm V_{on}/6$) which is $\frac{1}{3}$ of the amplitude of the change waveform $V'_{d,c}$ voltage provided to the data electrodes. The no-change and change waveforms are still of opposite phase.

The scan electrode "on" and "off" waveforms $V'_{s,on}$ and $V'_{s,off}$ (FIGS. 3*c* and 3*d*, respective1y) are, except during the interval T', squarewaves of the same phase and frequency as the change, data electrode waveform $V'_{d,c}$; the change, data electrode peak amplitude $\pm V_{ON}/2$ is reduced by a factor of 3 to provide the bias waveform with an amplitude of $\pm V_{ON}/6$. During the multiplex-scanning interval T', a single cycle of a squarewave, of the same basic frequency, is added to each of the bias square waveforms; the $V'_{s,on}$ waveform has a single cycle of $2V_{ON}/3$ amplitude added thereto, and of opposite polarity from the bias waveform (shown in broken line during the T' interval). Thus, the bias waveform positive and negative portions 46*a* and 46*b* are replaced with opposite-polarity portions 46*c* and 46*d*, respectively, of peak amplitude $V_{ON}/2$. The $V'_{s,off}$ waveform has an identical polarity squarewave single-cycle portion added thereto, of amplitude $V_{ON}/3$, changing the positive and negative polarity bias peak portions 48*a* and 48*b*, respectively, to like polarity half-cycles having a $V_{ON}/2$ amplitude peak.

Those matrix cells defined along any scan electrode having an "off" voltage and along a data electrode having a no-change voltage have a total absolute cell voltage waveform 50, as shown in FIG. 3*e*. During the time between scan intervals T', waveform 50*a* holds the cell at a total voltage of $V_{ON}/3$, while portion 50*b*, during scan interval T', increases the hold voltage to $2V_{ON}/3$, both of which levels are less than the $V_{ON}$ required to turn the individual cells to the "on" condition, but are greater than the voltage $V_{OFF}$ required to turn the cell to a low-transmissivity condition. Similarly, all cells defined by the no-change data electrode voltage and the "on" scan electrode voltage (FIG. 3*f*) have a substantially constant "hold" voltage thereacross, of peak amplitude $V_{ON}/3$, even during the scan interval T'. Therefore, any cell defined by the no-change data electrode voltage $V'_{d,n}$ will be "held" at the previously-activated state.

A cell receiving the "change" data electrode voltage $V'_{d,c}$ can receive a scan electrode "off" voltage $V'_{s,off}$ or a scan electrode "on" voltage $V'_{s,on}$, with the results being as shown in FIGS. 3*g* and 3*h*, respectively. A cell commanded to change to the "off" condition will, immediately prior to scan interval T', have a waveform portion 54*a* of peak magnitude $V_{ON}/3$, holding the previous value. In the scan interval T', the waveform portion 54b reduces to zero magnitude, turning the cell off. Thereafter, another "hold" voltage portion 54c commences, holding the cell in the "off" condition. Cells commanded to change to the "on" condition are, prior to scan interval T', subjected to a total voltage portion 56a of the "hold" magnitude $V_{ON}/3$. In the scan interval T', the waveform portion 56b increases to at least voltage $V_{ON}$, turning that cell on. Thereafter, the waveform portion 56c returns to the "hold" voltage magnitude and "holds" that cell in the "on" condition.

Referring now to FIGS. 4a–4e, it is often advantageous to operate the scan electrodes such that a non-zero potential is present only on that scan electrode presently being utilized to select a cell. Normally, sequentially addressing of a cholesteric liquid crystal matrix with a waveform having a zero voltage on an intersection, for any period of time, will cause a noticeable blink in the display as the zero voltage portion of the scan waveform allows the liquid crystal material to enter the focal conic texture (often spoken of as "erasing" the cell) before realigning the liquid crystal material in the homeotropic nematic condition when the cell is to be turned on. To erase only those elements of the matrix which have been, or which are going to be, in the focal conic, or "off", condition and also to reenforce homeotropy at those intersections where the display has been, or is going to be, in the homeotropic, or "on", condition, and thus eliminate blinking and any compromise of holding voltage, the data row electrode waveform voltages of FIGS. 4b and 4c are utilized with the scan voltage waveform of FIG. 4a.

The scan voltage $V_s$ waveform (FIG. 4a), applied to any one of the multiplicity of scan electrodes 14, starts each cycle (as defined at the scan electrode in question) with an erase time interval $T_1$, followed by a write interval $T_2$. Thereafter, the scan electrode voltage $V_s$ has a substantially zero magnitude portion for a time interval $T_0$. Thus, each scan electrode is active for a total active interval $T_1+T_2$, and the non-active interval $T_0$ is typically an integer number n of active intervals, i.e. $T_0=n(T_1+T_2)$, where n is an integer greater than 1 and equal to 1 less than the multiplexing factor M of the system. Typically, the total refresh cycle time $(T_1+T_2+T_0)$ is $M(T_1+T_2)$ Unlike the biased scan waveform case of FIGS. 3a–3h, which requires six different voltage levels, only four voltage levels are required for the multiplexing method of FIG. 3a–3e. Illustratively, the voltage level V is the "hold" voltage level (see FIG. 1b) and is substantially equal to one-half the cell "on" voltage $V_{ON}$.

The data row electrodes 16 receive one of the data "on" and data "off" voltages $V_{d,on}$ and $V_{d,off}$ voltages of FIGS. 4b and 4c, respectively. These data voltages are inversions of one another, having a first polarity and amplitude V during the non-scan periods and the same ampltude, but opposite polarity, during the active scan intervals ($T_1$ and $T_2$). Thus, the "on" data electrode voltage $V_{d,on}$ has a +V hold level and a −V active level while the "off" data electrode voltage $V_{d,off}$ has a −V hold level and a +V active level. The scan electrode voltage $V_s$ has, as previously stated, a substantially zero level except during the erase and write intervals, when the scan electrode waveform is respectively at the +V and +2V levels. It should be understood that the scan voltage, data-on voltage and data-off voltage waveforms are periodically inverted, as waveforms 60' 62' and 64', respectively, shown in the right hand portions of FIGS. 4a–4c. As the absolute amplitudes remaining constant and only the polarity is inverted, this periodic inversion causes the D.C. values to average to zero over a long period of time to prevent damage to the liquid crystal cells, in manner known to the art. Advantageously, the electrode waveforms may be alternatingly inverted at the beginning of each refresh cycle, e.g. at the start of each interval $T_1$, etc.

The "on" cell, at the intersection of an "on" data electrode receiving the $V_{d,on}$ signal and an active scan electrode receiving the $V_s$ signal, has the on-cell voltage $V_{on}$ waveform 66 (or its inverse waveform 66' during an inverted-polarity refresh cycle) of FIG. 4d. This waveform 66 is normally at a holding level having a first polarity and a first voltage, e.g. −V, during a waveform portion 66a prior to the erase-write interval, as illustrated. In the erase interval $T_1$, the portion 66b of the total voltage across the cell rises to substantially the on voltage $V_{ON}$ (equal to 2 V, in the illustrated embodiment) and of another polarity, e.g. the positive polarity, than the voltage during the hold interval $T_o$. Since this cell was either on, or about to be turned on, portion 66b acts to erase the cholesteric condition by stretching the coiled molecules toward the homeotropic condition and "presets" the cell in the "on" condition. Thereafter, in write interval $T_2$, the cell voltage portion 66c increases even further, e.g. to a level +3 V, which saturates the cell in the "on" condition. Thereafter, the on-cell waveform portion 66d reverts to the original, i.e. negative, polarity and to the hold voltage V level, holding the cell in the "on" condition. It will be seen that a previously "off" cell is reconditioned "on" by level 66b, fully and rapidly turned on by level 66c and held on thereafter by level 66d; thus, there is a single transition from "off" to "on", with no blinking, and with an "overdrive" condition during write interval $T_2$, serving to rapidly drive the cell, already preconditioned toward the "on" state, into high transmissivity.

A cell to be turned off has the total off voltage $V_{off}$ waveform 68 (or 68' during an inverted refresh cycle) of FIG. 4e, thereacross. Prior to the erase/write interval, the waveform portion 68a voltage is of the second polarity and V level, serving to hold the previously-enabled cell condition. During the erase time interval $T_1$, the net cell voltage in portion 68b falls substantially to zero, allowing the liquid crystal host to relax and start resuming the coiled cholesteric condition. Thereafter, in write interval $T_2$, the cell voltage returns to the hold level and, as the liquid crystal material has either begun resumption of the cholesteric state, or was already in the cholesteric state (having previously been in the "off" condition), continues to relax and turns fully to the "off" state. This state is held thereafter in portion 68d, until the next erase/write interval for that cell. It will again be seen that whatever previous state the cell was in, on being turned off by the waveform of FIG. 4e a single change to the "off" condition occurs without blinking. It will also be seen, by reference to the right-hand portions of FIGS. 4d and 4e, that a periodic reversal of the data and scan electrode waveforms also periodically reverses the on and off net cell voltage waveforms, as portions 66' and 68' respectively, to provide zero average D.C. voltage values preventing damage to the liquid crystal cell.

Figure 5:
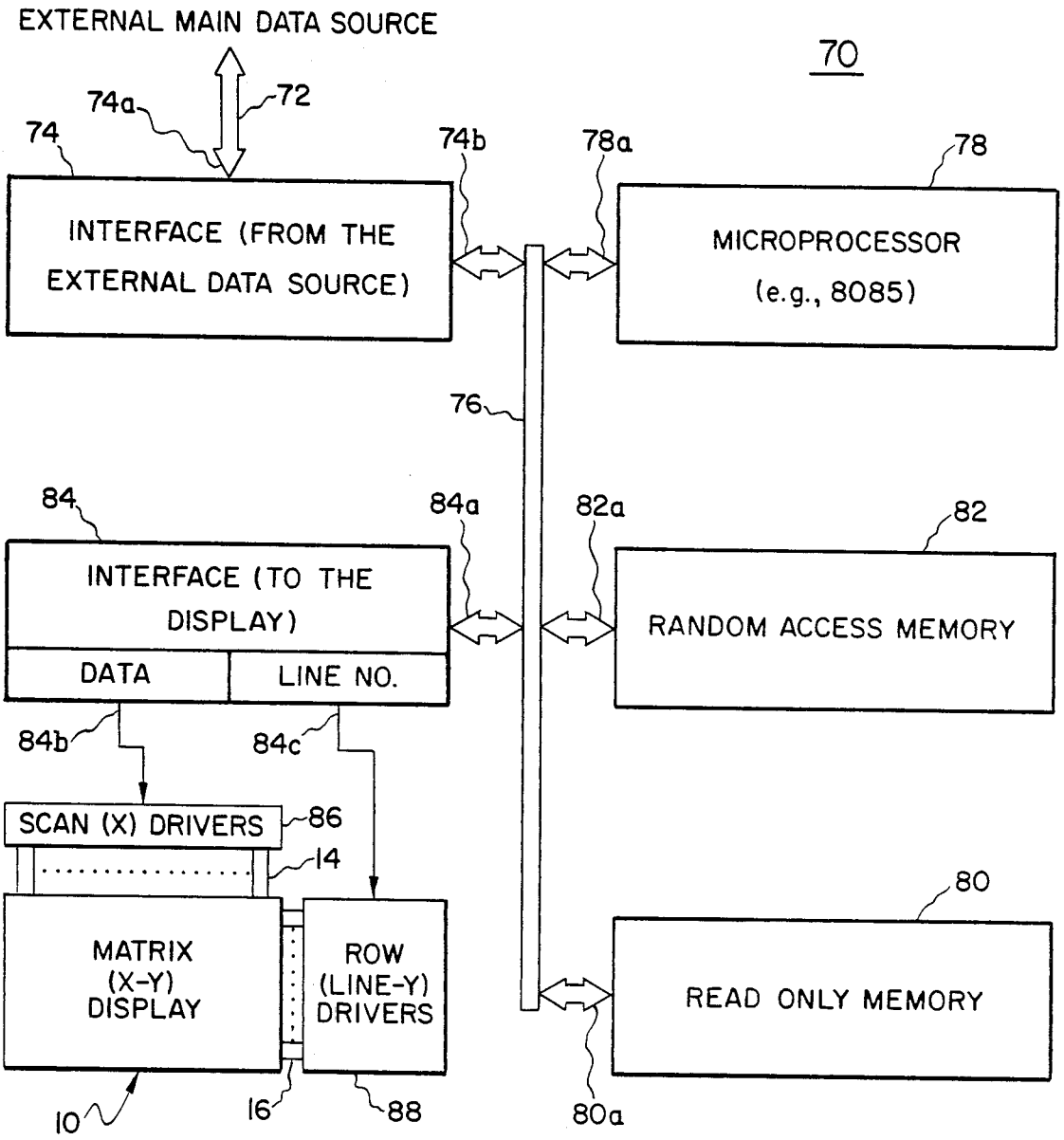
FIG. 5 is a schematic block diagram illustrating microprocessor-controlled apparatus for matrix addressing of a liquid crystal display.

Referring now to FIG. 5, the matrix display 10, illustratively of the X-Y matrix type, may be driven by a control system 70. System 70 receives display data from an external data source (not shown), via a bus 72, to a first port 74a of an external data source interface means 74, of type known to the art. Source interface means 74 may include capability to send data back to the external main data source (via a bidirectional bus 72 from a bidirectional port 74*a*) and will generally store incoming and/or outgoing data until requested by other system 70 components or by the external data source itself. Source interface means 74 may reformat the data it receives and may perform such operations as are necessary to provide/receive data in a desired format at a second port 74*b* to/from a central bidirectional system bus 76. A microprocessor 78, such as an Intel 8085 and the like, has an input/output port 78*a* connected to central bus 76. The data processing sequences carried out by microprocessor 78 may be in accordance with a program stored in a read-only memory (ROM) means 80, having an address-input/data-output port 80*a* connected to central bus 76. Random access memory (RAM) means 82, of sufficient storage capacity as dictated for the display selected, is also provided. RAM means 82 has an address-and-data input/output port 82*a* connected to the bidirectional main data bus 76. It should be understood that ROM means 80 and RAM means 82 may be part, along with microprocessor 78 and the interconnecting portions of bus 76, of a unitary microcomputer, in manner known to the art.

A display interface means 84 has a data input port 84*a* connected to the main bus 76, and receives data and line number information therefrom. In general, display interface means 84 includes only enough memory to provide intermittent storage of the number of that single line then to be operated upon at the display, and of the data condition of each cell of that single line of the display. The "present" condition of each cell of the entire display is contained, in a line-by-line manner, in specific display storage locations in RAM means 82 whereby the state of each cell can be changed via data from interface 74 and new data can be periodically provided from RAM means 82 to interface means 84, e.g. as for each refresh cycle. A first output 84*b* of the display interface means provides x-axis, or scan, electrode information to a display scan column driver means 86, itself providing the necessary waveforms and connections to each of the scan electrodes 14 of the display. A second display interface means output 84*c* provides y-axis, or data, electrode information to a display line (Y) row driver means 88, which provides the required waveforms and connections to each of the data electrodes 16.

Microprocessor 78, running under a program stored in ROM means 80, sequentially retrieves display information on a line-by-line basis from RAM means 82 for transmission through interface means 84 to the display drivers 86 and 88, for presentation on the matrix display 10. Microprocessor 78 may be programmed such that, for each line number sequentially called, the external source interface is checked for new cell information for the same line. If any cell on the line then requested, from RAM means 82, has been changed, the new cell information is provided both to the display interface means 84 and is placed in the line information re-stored in RAM means 82. In this manner, the cell condition information for each line may be updated during each refresh cycle, so that the latest data is utilized to drive the matrix display.

In a priority scan-matrix display embodiment of system 70, the incoming cell information, at external source interface means 74, is compared with the data stored for that particular cell address in RAM means 82. If the data already present at that cell address is the same, further action is not required. If the data stored at that location in RAM means 82 is different from the data received from interface means 74, microprocessor 78 causes the new data to be loaded into that storage location in RAM means 82. Immediately thereafter, the new cell data and cell location information is provided to the display interface means 84, such that the data row drivers 88 provide the appropriate waveform for the new cell data condition, simultaneously with the scan drivers 86 selecting the proper column for the cell to be updated; that cell, defined by the particular scan and row electrodes 14 and 16, respectively, is then updated. Therefore, the speed at which newly entered data is provided on display 10 is very rapid, even though the total time to scan a large display 10 might be several seconds. Since this form of "smart" control uses a priority to change display information, the drivers 86 and 88 should provide only that portion of the particular scan or data signal necessary to turn on or off the selected cell. As there may be relatively long intervals without regular scanning, the system maintains a zero average voltage level by utilizing a full cycle on both the data and enable voltages, as more particularly shown in FIGS. 2*c* and 2*d* or FIGS. 3*c* and 3*d*, for the scan voltages. The data electrode voltage waveform phase, or polarity, is selected dependent upon whether an element on an enabled column was to be turn on or off. The master program, stored in ROM means 80, enters a default condition during intervals when no change in display information occurs, and continually refreshes each cell of the display with "on" or "off" signals, as required, for the multiplexed matrix display 10.

Figure 6A:
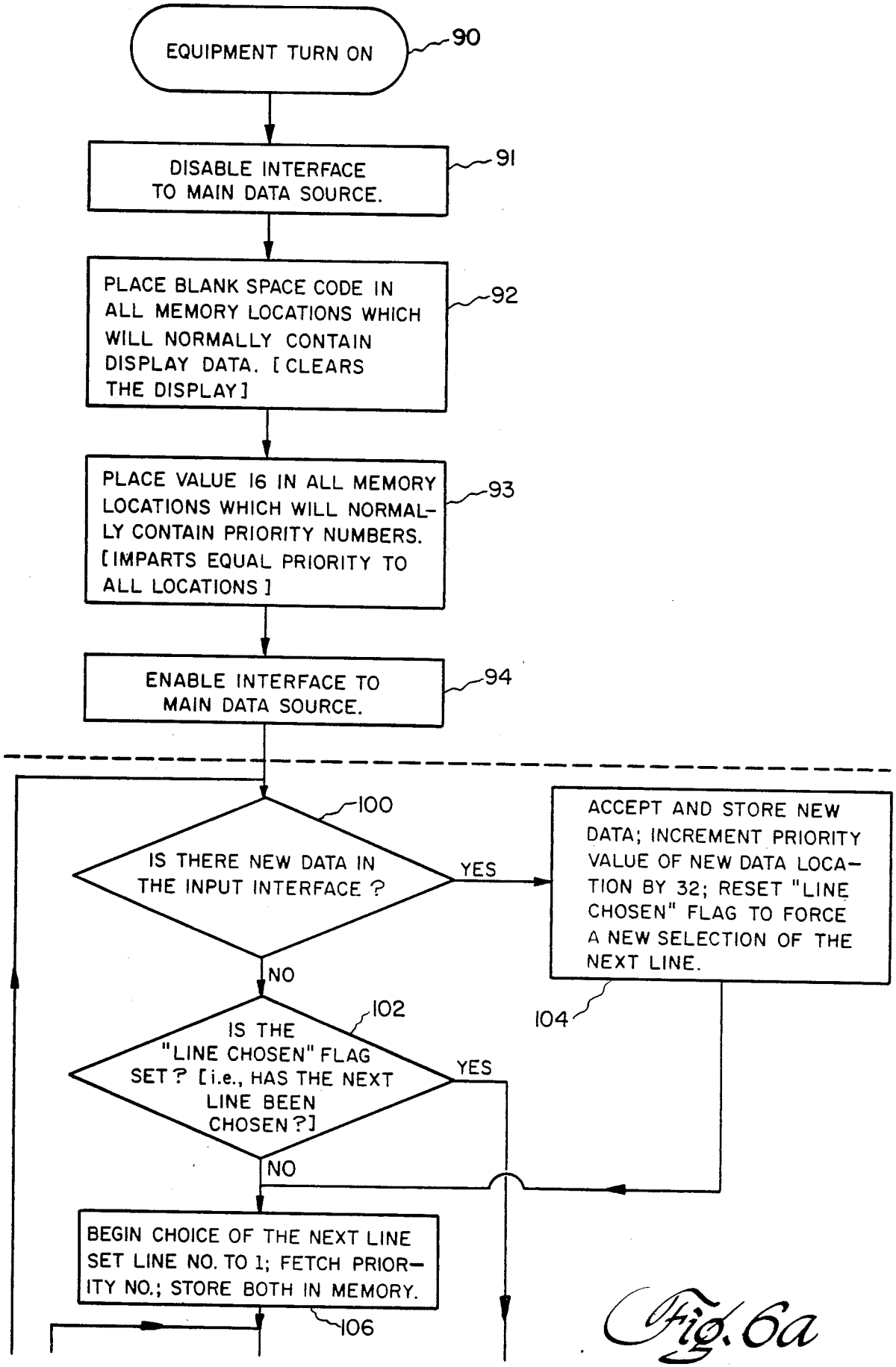
FIGS. 6*a* and 6*b* are interrelated portions of a flow chart illustrating the programming of the microprocessor apparatus of FIG. 5 for matrix addressing a liquid crystal display.
Figure 6B:
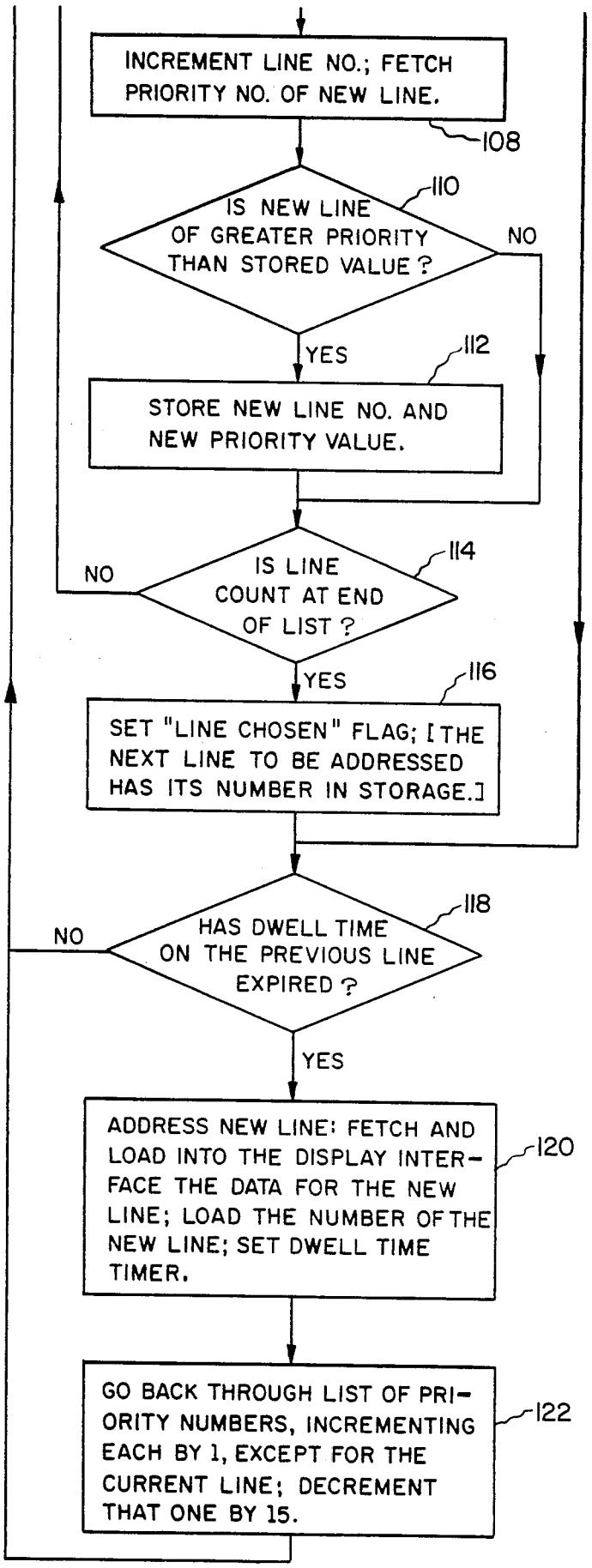

Referring now also to FIGS. 6*a* and 6*b*, one preferred priority-scan method of operation of system 70 commences, in step 90, when the system is turned on. Microprocessor 78 senses the system turn-on and under instructions retrieved from ROM means 80 sencs, in step 91, a signal to external main data interface means 74 to temporarily disable interface 74 from accepting data from the external main data source. Microprocessor 78, continuing under instructions from ROM means 80, sequentially accesses all of those memory locations in RAM means 82 utilized for storage of display cell locations and data and clears these memory locations in step 92. This essentially clears the display 10. Step 92 also clears, or resets, a portion of a memory register in which is contained a "line chosen" flag, indicative of whether the next line of the display has been chosen for updating.

In step 93, a starting priority value, e.g. priority number 16, is stored in all RAM means 82 memory locations which will normally contain a cell priority number. This imparts an equal cell-updating priority to all cell locations normally utilized; certain cell locations may be exempt from normal usage and utilized for display of data which does not frequently change. For example, a cell may be designated by a two-byte address (in a 500-by-500 pixel display), with sequential storage by the value of the first (line) byte. A third byte may contain the cell state in one data bit and contain a 7-bit priority number in the remainder of that third cell-information byte. A starting priority number, e.g. 16, which requires setting only one bit (e.g. the fifth bit) of the 8 bits in the condition/priority byte can be rapidly carried out by a "loop" technique.

After prioritizing all priority matrix cell bytes in memory, the program continues to step 94 and enables the external main data source interface means 74, to allow external data to be accepted by the system 70.

The priority-scan sub-routine commences at step 100, in which step the presence of new data in the external data source, or input, interface 74 is checked. At the start of operation, new data will generally not be in the input interface, and the "line chosen" flag will have been reset (step 92), so that the sub-routine rapidly passes through steps 100 and 102 and enters step 106. In general operation, interface means 74 may have new data; upon receipt of new information from the external main data source, interface means 74 provides a signal, in the form of a flag bit or interrupt, to microprocessor means 78. At the start of step 100, microprocessor 78 checks for the presence of the appropriate data word or interrupt to determine if there is new data in the input interface 74. If no new data is present in interface 74, the sub-routine exits to step 102, in which the state of the "line chosen" flag is checked, to determine if the next line of data for presentation to the display has been chosen. This choice may be carried out by sequentially augmenting a line register residing either in microprocessor means 78 or in a dedicated location of RAM means 82. If, on the other hand, step 100 determined that there was new data in the input interface, the program exits to step 104, where the new data is accepted and stored, for the particular line and/or cell locations, in RAM means 82. The (7-bit) priority value for that cell location is incremented by a preselected value, e.g. 32, to indicate that there is new, high-priority data at that storage location. The "line chosen" flag is reset such that the selection of a next line (steps 106–114 hereafter) is forced to occur.

The program has now either accepted the new data and conditioned the "line chosen" flag to call for a determination of a next line of highest priority (step 104) or has determined that there is no new data and that the "line chosen" flag is not set (step 102), either of which requires a choice of a next line to be scanned at the display; the program exits to step 106. In this step, the next-line-number choice begins: the "next line" register is initially set to line 1; the priority number for the line specified in the "next line" register, e.g. line 1, is retrieved and both the line number and its priority number are stored in a temporary memory location, such as a register in microprocessor means 78. Thereafter, step 108 is entered, the "next line" register is incremented by 1 and the priority number for the priority number for the new line, e.g. line 2, is fetched from memory. Thereafter, step 110 is entered and the priority number for the new line number, e.g. line No. 2, is compared to the priority number for the previously-stored line number, e.g. line No. 1. If the new line number priority value is greater than the previously-stored lower line number priority value, step 110 is entered and the most-recent line number and its priority value are stored in the temporary register location. If the most-recently-retrieved line priority number is not greater than the previously-stored line priority number, step 110 exits directly to step 114. The line number count is checked, in step 114, to see if all lines have been tested to find the first-occurring line of highest priority. If the line count has not completely cycled through all lines of the display, step 114 exits back to step 108 and steps 108, 110, 112 and 114 are repeated for each new line number, until all lines have been tested for priority. Eventually, the priority value of the last-numbered line is compared to the highest previous priority value and the line count is at the end of the list. Step 114 now exits to step 116, where the "line chosen" flag is set, to indicate that the next display line to be addressed has its line number in the temporary storage register. Once the "line chosen" flag is set in step 116, or if step 102 has found that the "line chosen" flag is already set, step 118 is entered and the dwell, or refresh, time for the line of the display presently being driven, is checked. If this dwell time has not expired, the line refresh sequence continues for that previously-chosen line, and the program returns to the sub-routine input step 100. This allows the very latest input data priority values to be checked in steps 100–116, prior to again entering step 118. Once the dwell-refresh time for the previous line has expired, step 120 is entered. In step 120, the number and cell data for the new, highest priority line (having its line number stored in the temporary register) is fetched from RAM means 82, is loaded into the display interface means 84 (through port 84*a*) and a refresh-dwell timer is set, to allow sufficient time for the row of data cells to be driven to display the line of data. While this is occurring at the display, the microprocessor decreases the priority number of each cell of the present line by 15 (as there is now no great priority to display this line) and increases the priorities of each other line by one, in step 122. The sub-routine ends and returns to step 100. If no new data is received, the sub-routine goes down the line list, refreshing first those lines with highest priority numbers (generally indicative of being a line waiting the longest to be refreshed) and refreshes all lines in order of priority. Due to the incrementing of the priority value of each remaining line as each higher priority line is refreshed (and decrementing, by a value which is advantageously equal to the multiplexing order of the display) the line currently being refreshed, each line will be cyclically refreshed and will continue to provide viewable data. Any data newly arrived from the main data service will be given a higher priority (e.g. priority 32) and rapidly inserted into the display, before the cyclic refresh process recommences.

While several presently preferred methods and apparatus for matrix-addressing of a cholesteric liquid crystal display have been described herein, many variations and modifications will now become apparent to those skilled in the art. It is our intent, therefore, to be limited only by the scope of the appending claims and not by way of the specific instrumentalities described by way of general description herein.

What is claimed is:

1. A method for addressing a multiplexible cholesteric-nematic liquid crystal display, comprising the steps of:

(a) defining each of a matrix of display cells by the intersection of one of a first plurality of data electrodes extended in a first direction and one of a second plurality of scan electrodes extended in a second direction different from said first direction, each cell requiring a signal of a first potential with at least a known magnitude $V_{on}$, between the associated data and scan electrodes defining that cell, to place said cell in a first optical condition;

(b) maintaining the signal on each of the second plurality of scan electrodes at a substantially zero amplitude, with respect to a common electrode reference potential, except when a particular one of said scan electrodes is active;

(c) providing first and second cyclic data electrode signals of substantially the same waveshape and peak amplitude determined solely by the known magnitude $V_{on}$, with respect to said common reference potential, and with substantially opposite phase;

(d) individually connecting a selected one of the first and second oppositely-phased signals to each individual data electrode along a line of cells, defined by that single active scan electrode anywhere in the matrix and then receiving a non-zero amplitude signal, to condition each cell along that line to be respectively capable and incapable of a change of optical condition;

(e) sequentially activating each of the entire second plurality of scan electrodes with a first scan signal having a predetermined number of cycles of the same waveshape as the data electrode signals and also having a selected one of a pair of selected combinations of one of first and second peak amplitudes, each based solely on said known signal magnitude $V_{on}$ and independent of the number of lines being activated in any sequence, and one of first and second phases, to drive to the first optical condition all of the cells receiving both the first scan signal and the data electrode signal defining a change-capable condition;

(f) then sequentially activating each of the entire second plurality of scan electrodes with a second scan signal, also having the data electrode signal waveshape for said predetermined number of cycles and having the combination of the remaining one of the first and second peak amplitudes and the remaining one of the first and second phases, to drive to a second optical condition, opposite to the first optical condition, all of the cells receiving both the second scan signal and the data electrode signal defining a change-capable condition; and (g) maintaining in a previous optical condition the remaining matrix cells receiving the change-incapable signal and not being activated by either of steps (e) or (f).

2. The method of claim 1, further comprising the step of adding a cyclic bias waveform signal, of one-half the amplitude of the data electrode signal, to all of said data electrode and scan signals.

3. The method of claim 1, wherein step (e) includes the step of: providing the single cycle of the first scan signal with substantially the same instantaneous polarity as the instantaneous polarity of the change-incapable data electrode signal; and step (f) includes the step of providing the single cycle of the second scan signal with substantially the same single cycle of the instantaneous polarity as the instantaneous polarity of the change-capable data electrode signal.

4. The method of claim 1, wherein: step (c) includes the step of setting the peak amplitude of each of the first and second data electrode signals substantially equal to one-third the first potential; step (e) includes the step of setting the peak amplitude of the first scan signal to be substantially equal to twice the data electrode signal peak amplitude; and step (f) includes the step of setting the peak amplitude of the second scan signal to be substantially equal to the peak amplitude of the data electrode signals.

5. The method of claim 4, further comprising the step of adding a cyclical bias waveform signal of one-half the amplitude of the data electrode signals, to all of the data electrode and scan signals.

6. The method of claim 5, further comprising the step of providing said bias signal with the same waveshape as said data electrode signals.

7. The method of claim 6, wherein said bias signal waveform is in-phase with the change-capable data electrode signal waveform.

8. The method of claim 7, wherein said bias signal has a peak amplitude equal to one-half the peak amplitude of said first and second data electrode signals.

9. The method of claim 1, further comprising the steps of: providing only two pairs of potentials, with the pairs of potentials having integer relationships to one another and with the potentials of each pair having the same amplitude but opposite polarity; and switching between the four potentials to generate the various ones of the data electrode and scan signals.

10. The method of claim 9, wherein the data electrode signals are provided by the step of periodically switching between the pair of potentials of the lesser amplitude.

11. The method of claim 10, wherein the second scan signal is also provided by the step of periodically switching between the pair of lesser-amplitude potentials.

12. The method of claim 11, wherein the first scan signal is provided by the step of periodically switching between the pair of greater-amplitude potentials.

13. The method of claim 12, wherein the greater-amplitude potentials are approximately twice the amplitude of the lesser amplitude potentials.

14. The method of claim 9, wherein one of the data electrode signals is provided by the step of periodically switching between the opposite-polarity potentials of the lesser-amplitude pair of potentials; and the remaining data electrode signal is provided by the step of periodically switching between the opposite-polarity potentials of the greater-amplitude pair of potentials.

15. The method of claim 14, wherein the first and second scan signals are each provided by switching between all four potentials in accordance with a predetermined sequence which is different for each of the scan signals.

16. A method for addressing a multiplexible cholesteric-nematic liquid crystal display, comprising the steps of:

(a) defining each of a matrix of display cells by the intersection of one of a first plurality of data electrodes extended in a first direction and one of a second plurality of scan electrodes extended in a second direction different from said first direction, each cell requiring a signal of a first potential with at least a known magnitude $V_{on}$, between the associated data and scan electrodes defining that cell, to place said cell in a first optical condition;

(b) maintaining the signal on each of the second plurality of scan electrodes at a substantially zero amplitude except when a particular one of said scan electrodes is active while the remainder of the scan electrodes are inactive;

(c) maintaining the signal on each of the first plurality of data electrodes at a non-zero amplitude and with a polarity selected to control the cell to a selected one of first and second optical conditions;

(d) temporarily inverting the polarity of the signal at each data electrode during any scan time interval when any one of the second plurality of scan electrodes is active;

(e) driving the single scan electrode then active with an erase signal of a first magnitude during a first portion of the scan time interval for that scan electrode, to cause those cells receiving the erase signal and a first polarity of data electrode signal to be placed in the first optical condition, while cells receiving the second data electrode polarity and the erase signal are preconditioned toward, but not placed in, a second optical condition, opposite to the first optical condition; and (f) then driving the single active scan electrode, during the remaining portion of the same scan time interval, with a write signal having an amplitude greater than the erase signal amplitude in the first portion of the same scan time interval, to cause those cells receiving the write signal and the second polarity of data electrode signal to be then placed in the second optical condition, while cells receiving the write signal and the data electrode signal of the first polarity are maintained in the first optical condition.

17. The method of claim 16, further comprising the step of periodically reversing the polarity of all of said data electrode and scan signals to provide an average D.C. voltage of substantially zero volts across each display cell.

18. The method of claim 16, further comprising the steps of: selecting a holding voltage greater than a voltage required to control a display cell to an off condition and less than that voltage $V_{on}$ required to control a display cell to an on condition; setting the amplitude of the data electrode signals to the amplitude of said holding voltage; setting the amplitude of the scan signal to said holding voltage during said scan time interval first portion; and setting the scan signal to an amplitude substantially equal to twice the holding voltage and greater than the on voltage $V_{on}$, during the remaining portion of the scanned time interval.

19. The method of claim 18, further comprising the step of setting the holding voltage substantially equal to one-half the on-condition amplitude.

20. A method for priority scan addressing of a multiplexible display having a multiplicity of display cells each arranged along one of a plurality of numbered display lines, comprising the steps of:

(a) providing a multiplicity of memory spaces, each associated with a different one of the display cells;

(b) providing an initial value for a variable-value priority number for each different display cell;

(c) storing the line number, priority number and display data for each cell in the associated memory space for that cell;

(d) cyclically accessing all memory spaces to selected the line number with at least one cell thereon with the highest present priority number;

(e) retrieving display cell information for all cells having the same line number as, and situated on, the selected single display line with a first-encountered cell having the highest priority number;

(f) updating the actual displayed data for all cells along the single selected display line selected in step (e);

(g) decreasing by a fixed amount the stored priority number for all display cells in the single line being then updated, the stored priority number not being decreased below a minimum priority number; and (h) sequentially repeating steps (d)–(g).

21. The method of claim 20, further comprising the steps of:

(i) accepting, from an information source, new cell display data for an identified display cell;

(j) storing the new cell display data in the display data portion of the memory space for the identified display cell; and (k) increasing, by a selected amount, the priority number stored in the memory space for the identified display cell.

22. The method of claim 21, further comprising the step of causing the sequence of steps (d)–(g) to be initiated whenever new data is entered into any display cell memory space in accordance with steps (i)–(k).

23. The method of claim 22, further comprising the step of inhibiting the initiation of a step (d)–step (g) sequence until completion of steps (e)–(g) for a line of data cells presently being addressed.

24. The method of claim 20, wherein step (g) includes the step of decreasing, by a number equal to one less than the original priority number, the stored priority number for each of the display cells along that display line having been updated in the preceding step (f).

25. The method of claim 20, wherein step (g) further includes the step of incrementing, by one, the priority number of each cell along each display line other than the single line of display cells then being updated.

26. Apparatus for priority scan matrix addressing of a multiplexible display having a multiplicity of display cells with each cell being defined by the intersection of one of a first plurality of first electrodes and one of a second plurality of second electrodes and each cell being arranged along one of a plurality of numbered display lines, comprising:

first driver means for providing a proper display driving signal to that one of said first electrodes selected responsive to a present-line number signal;

second driver means for simultaneously providing proper display driving signals to all of said second electrodes for controlling all of the cells along the selected first electrode number display line to the proper display condition, responsive to display-condition cell information for that numbered first electrode display line;

memory means for storing information as to the present display condition of each cell, the number of the display line in which that cell is contained, and a variable priority number associated with that display cell; and controller means for (a) determining the first electrode display line having a cell with a highest present priority number, for (b) then providing the number of that display line as the present-line number signal to said first driver means, and for (c) then providing the present display-condition cell information to said second driver means to cause the information in every cell on that numbered line on said display to be modified in accordance therewith.

27. The apparatus of claim 26, wherein said controller means also functions for (d) decrementing the priority number stored in said memory means for each cell along that number display line then being acted upon as a present-line.

28. The apparatus of claim 27, wherein said controller means decrements the priority number of each cell along the present-line display line by an equal predetermined amount.

29. The apparatus of claim 28, wherein there is a minimum value below which said priority number cannot be decremented by said controller means.

30. The apparatus of claim 26, further comprising: means for receiving new display-condition cell information from an external data source for a denominated cell; and wherein said controller means also functions for (e) placing the new display-condition cell information in the memory space assigned to the denominated display cell, and (f) increasing by a predetermined amount the priority number assigned to the denominated cell.

31. The apparatus of claim 30, wherein said controller means further functions for (g) thereafter re-determining the number of the first electrode display line having a cell with the highest priority number, after each reception of new display-condition cell information by said receiving means.

32. The apparatus of claim 31, wherein said controller means also functions for (h) inhibiting first electrode display line re-determination if a display line is then being modified.

33. The apparatus of claim 32, wherein said controller means comprises a microcomputer.

* * * * *